US007300335B2

(12) United States Patent
Tajima et al.

(10) Patent No.: US 7,300,335 B2
(45) Date of Patent: Nov. 27, 2007

(54) GLASS SUBSTRATE FOR DATA RECORDING MEDIUM, MANUFACTURING METHOD THEREOF AND POLISHING PAD USED IN THE METHOD

(75) Inventors: Hirokazu Tajima, Osaka (JP); Tamaki Horisaka, Osaka (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 10/765,459

(22) Filed: Feb. 11, 2004

(65) Prior Publication Data

US 2004/0180611 A1 Sep. 16, 2004

(30) Foreign Application Priority Data

Feb. 12, 2003 (JP) ..... 2003-034094

(51) Int. Cl.
*B24B 7/30* (2006.01)
*B24D 11/00* (2006.01)

(52) U.S. Cl. ..... 451/41; 451/57; 451/533

(58) Field of Classification Search ..... 451/41, 451/57, 63, 527–533, 262, 269, 56, 526
See application file for complete search history.

(56) References Cited

U.S. PATENT DOCUMENTS 3,284,274 A * 11/1966 Hulslander et al. ..... 442/63
4,433,510 A * 2/1984 Katagiri et al. ..... 451/269
5,980,366 A * 11/1999 Waddle et al. ..... 451/262
6,284,114 B1 * 9/2001 Chechik et al. ..... 204/483
6,322,425 B1 * 11/2001 Darcangelo et al. ..... 451/41
6,371,834 B1 * 4/2002 Fujimura et al. ..... 451/41
6,439,965 B1 8/2002 Ichino et al. ..... 451/36
6,811,467 B1 * 11/2004 Beresford et al. ..... 451/41
6,890,244 B2 * 5/2005 Hsu et al. ..... 451/41
7,025,668 B2 * 4/2006 Petroski et al. ..... 451/526
2002/0016145 A1 2/2002 Tominaga et al.

FOREIGN PATENT DOCUMENTS

JP 2001-358101 12/2001
JP 2002-036129 2/2002
JP 2002-092867 3/2002
JP 2003-006843 1/2003
JP 2003-220550 8/2003

* cited by examiner

*Primary Examiner*—Hadi Shakeri
(74) *Attorney, Agent, or Firm*—Marsh Fischmann & Breyfogle

(57) ABSTRACT

A polishing pad is used when a surface of a glass workpiece is polished for manufacturing a glass substrate of information recording medium. The polishing pad has a nap layer. The nap layer includes an inner layer that contains a plurality of closed cells, and an outer layer. A plurality of pores are formed on the surface of the outer layer. The sizes of the pores are minute compared to those of the closed cells.

5 Claims, 2 Drawing Sheets

GLASS SUBSTRATE FOR DATA RECORDING MEDIUM, MANUFACTURING METHOD THEREOF AND POLISHING PAD USED IN THE METHOD

BACKGROUND OF THE INVENTION

The present invention relates to a glass substrate of an information recording medium used in a magnetic disk, a magneto-optic disk, or an optical disk, which are magnetic recording medium of information recording devices such as hard disks. The present invention also relates to a method for manufacturing such a glass substrate and a polishing pad used in the method.

Conventionally, to permit a glass substrate of an information recording medium (hereinafter also referred to as a glass substrate) to record high density information, the surface of the glass substrate needs to be as smooth as possible. Therefore, during manufacturing, a surface of a glass substrate is polished by supplying a polishing agent on the surface and rubbing the surface with a polishing pad so that the surface becomes smooth. For example, Japanese Laid-Open Patent Publication No. 2002-92867 discloses a glass substrate having an improved value of micro-waviness, which is one of the values representing the smoothness of the surface. In the publication, the micro-waviness of a surface of the glass substrate is improved by selecting the surface roughness of a polishing pad. This proposition utilizes a phenomenon that the value of the micro-waviness of a glass substrate depends on the surface roughness of a polishing pad.

However, since the polishing pad used in the above prior art includes foam, a number of pores are formed in the surface. Thus, the surface roughness of the polishing pad does not necessarily depend on the value of the micro-waviness of the glass substrate. That is, when measuring the surface roughness of a polishing pad with a probe meter, the pin of the probe meter enters pores formed in the surface of the polishing pad. Thus, the value of the surface roughness evaluated in the entire surface of the polishing pad reflects the depth of each pore. At this time, the influence of the depths of pores to the value of the surface roughness can be reduced by adjusting the cut-off value (λ). However, the pores have significantly varied depths, and it is practically impossible to measure the depths of all the pores. Therefore, it is extremely difficult to accurately measure the surface roughness by completely eliminating the influence of the depths of the pores. Thus, even if a measured surface roughness of a polishing pad has a desirable value, it is likely that the surface of the pad is rough. When such a polishing pad is used for polishing the surface of a glass substrate, the value of the micro-waviness on the surface is unlikely to have a desirable value.

SUMMARY OF THE INVENTION

The present invention was made for solving the above problems in the prior art. Accordingly, it is an objective of the present invention to provide a method for manufacturing a glass substrate for a data recording medium, which method is capable of selecting polishing pads having a desirable surface condition for polishing, thereby improving the surface condition of the glass substrate.

To achieve the foregoing and other objectives and in accordance with the purpose of the present invention, a polishing pad used for manufacturing a glass substrate of an information recording medium by polishing a surface of a glass workpiece is provided. The polishing pad includes an inner layer that contains a plurality of closed cells, and an outer layer. A plurality of pores in a nap layer, are formed on the surface of the outer layer. The sizes of pores are minute compared to those of the closed cells. Also, the pores are formed like cavities.

In another aspect of the present invention, a method for manufacturing a glass substrate of an information recording medium by polishing a surface of a glass workpiece with a polishing pad is provided. Polishing of the method includes a first polishing step for subjecting a surface of the glass workpiece to rough polishing, and a second polishing step for subjecting the surface of the glass workpiece to precision polishing so that the surface is further smoothed. The polishing pad is used in the second polishing step.

The present invention also provides a glass substrate of an information recording medium, manufactured by a method for manufacturing a glass substrate of an information recording medium by polishing a surface of a glass workpiece with a polishing pad. Polishing of the method includes a first polishing step for subjecting a surface of the glass workpiece to rough polishing, and a second polishing step for subjecting the surface of the glass workpiece to precision polishing so that the surface is further smoothed. The polishing pad is used in the second polishing step. When measured with a three-dimensional external structure analysis microscope at a wavelength (λ) of 0.2 to 1.4 mm, the height (NRa) of micro-waviness on the surface is equal to or less than 0.15 nm.

Further, the present invention provides a method for manufacturing a polishing pad. The polishing pad is formed by sliding a pad dresser made of a metal disk, on the surface of which diamond abrasive grains are electrodeposited, against a non-buff pad made of foam to polish the non-buff pad.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3(*b*) is a view showing a cross-section of a soft polisher taken with the SEM;

FIG. 4(*b*) is a view showing a cross-section of a prior art polishing pad taken with the SEM.

DETAILED DESCRIPTION OF THE PREFERRED EMBODIMENTS

A preferred embodiment of the present invention will now be described with reference to the drawings.

A glass substrate for a data recording medium (hereinafter, simply referred to as glass substrate) is made of a glass workpiece. The glass substrate is shaped as a disk having a circular hole in the center. The glass workpiece is a disk that is cut out of a glass sheet. The surface of the glass workpiece is polished with a polishing apparatus 41. The glass workpiece is formed of a glass material such as soda lime glass, aluminosilicate glass, borosilicate glass, and crystallized glass, which are manufactured by a float process, a down draw process, a redraw process, or a press process. Then, a magnetic layer of a metal or an alloy such as cobalt (Co), chromium (Cr), and iron (Fe), and a protective layer are formed on the glass substrate, which is obtained from the glass workpiece, to produce a data recording medium such as a magnetic disk, a magnetic optical disk, and an optical disk.

Figure 2:
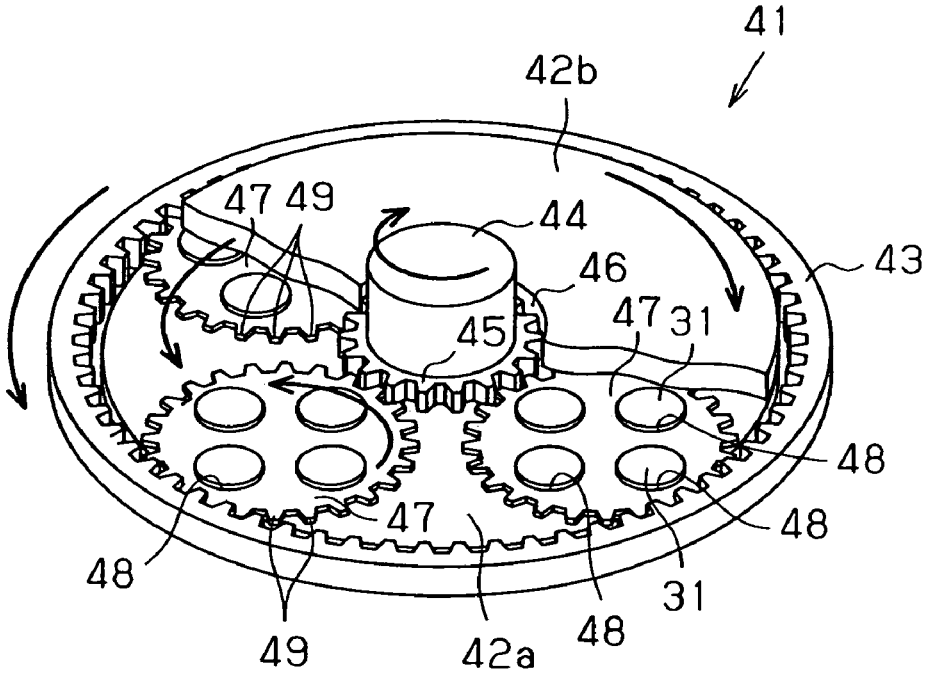
FIG. 2 is a perspective view, with a part cut away, showing a batch type polishing apparatus.

As shown in FIG. 2, the polishing apparatus 41 includes an upper surface plate 42*b*, a lower surface plate 42*a*, and an annular internal gear 43. The upper and lower surface plates 42*b*, 42*a* are arranged parallel to each other and vertically spaced from each other. The internal gear 43 surrounds the upper and lower surface plates 42*b*, 42*a*. A rotary shaft 44 projects from the center of the lower surface plate 42*a*. A sun gear 45 is provided about the lower end portion of the rotary shaft 44. A through hole 46 is formed in the center of the upper surface plate 42*b*. The rotary shaft 44 extends through the through hole 46. The upper surface plate 42*b*, the lower surface plate 42*a*, the internal gear 43, and the sun gear 45 are independently rotated with motors. Carriers 47 are provided between the lower surface plate 42*a* and the upper surface plate 42*b*. Each carrier 47 has a circular holes 48. Each hole 48 holds a glass workpiece 31. A gear 49 is formed at the circumference of each carrier 47. The gear 49 is engaged with the internal gear 43 and the sun gear 45.

In the polishing apparatus 41, polishing pads are attached to the surfaces of the lower and upper surface plates 42*a*, 42*b* as necessary. The polishing pads are made of synthetic resin foam. Each glass workpiece 31 is accommodated in one of the circular holes 48 of the carriers 47 and held between the lower surface plate 42*a* and the upper surface plate 42*b*, that is, between a pair of polishing pads. In this state, polishing agent is supplied to the surface of the glass workpiece 31 from a supplying portion (not shown) through the lower surface plate 42*a*, the upper surface plate 42*b*, and the polishing pad. That is, the polishing pads of the lower surface plate 42*a* and the upper surface plate 42*b* have supply holes (not shown) extending along the thickness direction. Polishing agent is supplied to the supply holes from the supply portion such as a tank that stores the polishing agent. When the upper surface plate 42*b*, the lower surface plate 42*a*, the internal gear 43, and the sun gear 45 are independently rotated, the carriers 47 each rotate and orbit about the center of the rotary shaft 44, with the glass workpieces 31 contacting the lower and upper surface plates 42*a*, 42*b*, or the polishing pads.

The height (NRa) of micro-waviness on each glass substrate is equal to or less than 0.15 nm. The surface roughness (Ra) is preferably equal to or less than 0.4 nm, and the waviness height (Wa) of the surface is preferably equal to or less than 0.5 nm. The surface roughness (Ra) represents a value measured by an atomic force microscope (AFM). The waviness height Wa is measured with a multifunctional interferometer manufactured by Phase Matrix, Inc. at a wavelength (λ) of 0.4 mm to 5.0 mm by scanning a predetermined area on the surface with white light. The micro-waviness height NRa is measured with a three-dimensional external structure analysis microscope manufactured by Zygo Corporation at a wavelength (λ) of 0.2 mm to 1.4 mm by scanning a predetermined area on the surface with white light.

If the surface roughness Ra and the waviness height Wa of the glass substrate exceed 0.4 nm and 0.5 nm, respectively, the surface of the glass substrate will be rough, and the quality will deteriorate with a low smoothness. This is because, when the distance between a head for reading data recorded and the surface of the data recording medium is shortened to increase the recording density, the head cannot pass over or follow asperities on the surface, and may collide with or may be stuck with such asperities. Since this drawback will be more pronounced if the micro-waviness height NRa exceeds 0.15 nm, the micro-waviness height NRa needs to be equal to or less than 0.15 nm.

A method for manufacturing the glass substrate for the data recording medium will now be described.

The glass substrate is manufactured through a machining process, a chamfering process, a lapping process, a polishing process, and a cleaning process.

In the machining process, the glass workpiece is cut using a cutter made of carbide alloy or diamond so that the circular hole is formed in the center of the workpiece. In the chamfering process, the inner circumferential surface and the outer circumferential surface of the glass workpiece are ground so that the measurements of the outer circumferential surface and the inner circumferential surface have predetermined values. In this process, the corners of the inner and outer circumferential surfaces are chamfered.

In the lapping process, the glass workpiece is lapped to reduce the amount of curling in the entire glass workpiece so that the glass workpiece becomes substantially flattened. The lapping process is performed by polishing the surface of the glass workpiece 31 by sliding the lower surface plate 42*a* and the upper surface plate 42*b* on the glass workpiece 31 while supplying a polishing agent onto the surface of the glass workpiece 31. In the lapping process, a suspension, or slurry in which abrasive grains are dispersed in water, is used as the polishing agent. The grains are particles of, for example, alumina.

In the polishing process, polishing pads are attached to the lower surface plate 42*a* and the upper surface plate 42*b*, and the pads are caused to slide on the surfaces of the glass workpiece 31. In the polishing process, the surfaces of the glass workpiece are polished with the polishing pads and become smoothed. In the cleaning process, polishing agent, polishing powder, and dust are removed from the surfaces of the glass workpiece that has been polished. Accordingly, a glass substrate having smooth surfaces with an improved cleanliness is manufactured.

The polishing process includes a first polishing step for subjecting the surfaces of the glass workpiece to rough polishing, and a second polishing step for subjecting the surfaces of the glass workpiece to precision polishing so that the surfaces are further smoothed.

Through the first polishing step, the thickness of the glass workpiece is adjusted to a predetermined value. The first polishing process also eliminates defects such as curling, waviness, chippings, and cracks. These defects are present substantially in a certain range of thickness from each surface of the glass workpiece. To make the entire glass workpiece have a constant thickness, part of each surface is removed by polishing. Accordingly, the defects are removed. Among these defects, surface waviness is formed in lines on the surfaces when the glass plate from which the glass workpiece is formed is manufactured through, for example, a float process. Therefore, the glass workpiece inherently has waviness. The first polishing step is performed chiefly for improving the surface waviness.

In the rough polishing of the first polishing step, a removal layer that contains defects is removed from each surface of the glass workpiece. Therefore, the thickness of the removal layer is carefully determined. Also, since the objective of the polishing process is to smooth the surfaces of the glass workpieces, if the surfaces of the glass workpiece are roughened by the first polishing step, the result would be against the objective of the process. Thus, in the first polishing step, the surfaces of the glass workpiece are carefully prevented from being damaged, so that the surfaces are smoothed after the first polishing step. In the first polishing step, hard polishers are used as the polishing pads so that part of the glass workpiece is removed without damaging the surfaces of the glass workpiece.

The hard polishers are made of foam of coarse sponge with visible pores, such of a synthetic resin such as polyurethane or polyester. The hard polisher has a hardness of 65 to 95 of JIS A as classified in Japanese Industrial Standard (JIS) K6301. The compression modulus of the hard polisher is 60 to 80%. It is preferable to adhere the polishers to the lower surface plate 42*a* and the upper surface plate 42*b* such that the compressibility of the hard polishers is 1 to 4%.

If the hard polishers have a hardness of less than 65 of JIS A, a compression modulus less than 60%, or a compressibility more than 4%, the hard polishers do not have a desirable hardness. In this case, it takes long time to each hard polisher for remove a removal layer of a predetermined thickness from the glass workpiece. In addition, each hard polisher will be deformed during polishing and thus can form asperities and waviness on the surface. This will result in defects such as waviness on the surfaces of the glass workpiece, and the surfaces will not be smooth. If the hardness is greater than 95 of JIS A, the compression modulus is higher than 80%, or the compressibility is less than 1%, the hard polishers damage the surfaces of the glass workpiece, and roughen the surface.

In the rough polishing of the first polishing step, a suspension, or slurry in which abrasive grains are dispersed in water, is used as a polishing agent. The grains are particles of, for example, cerium oxide. Cerium oxide not only physically grinds glass material but also chemically melts the material. Therefore, cerium oxide is suitable for cases where the thickness of the removal layer of the glass material is carefully determined or where time for polishing needs to be shortened. The average size of the abrasive grains is preferably equal to or less than 1.5 μm, and more preferably 0.2 to 1.5 μm. If the grain size is excessively great, the abrasive material forms scratches on the surfaces of the glass workpiece. If the grain size is excessively small, the polishing amount in a unit of time is decreased, which results in an extended time for polishing and thus a lowered productivity.

Through the second polishing step, the glass workpiece is subjected to precision polishing so that a significantly small amount of the surfaces is removed to correct minute defects on the surfaces, such as minute waviness and minute asperities. Most of these minute defects are formed in the lapping process, polishing in the first polishing step, and deformation due to stress applied by polishing. In the second polishing step, projecting portions of the waviness and asperities are ground off so that the surfaces are smoothed. That is, the second polishing step is performed chiefly for improving the surface micro-waviness and the surface roughness. If removal of all the minute defects like waviness is attempted, scratches may be formed on the surfaces of the glass workpiece when the minute defects are ground, and the scratches become new defects. As a result, the attempt may increase defects.

In the precision polishing of the second polishing step, the surfaces of the glass workpiece are polished and smoothed so that the surfaces become mirror-finished surfaces. Therefore, the thickness of the removal layer is not carefully determined. In contrast, the top portions of the minute defects are carefully removed without damaging the surfaces of the glass workpiece. Therefore, in the second polishing step, soft polishers are used as the polishing pads so that part of the surfaces of the glass workpiece are polished without being ground by a great amount. The soft polishers are made of foam of a synthetic resin such as polyurethane or polyester, which foam is formed like suede and has pores that are too small to be visible.

The precision polishing performed on the surfaces of the glass workpiece with the soft polishers made of foam will now be described in detail. First, the abrasive grains in the polishing agent enter pores on the surface of the soft polisher. The abrasive grains repeatedly enter and exit the pores. When the abrasive grains exit the pores, the grains enter spaces between walls defining the pores and the surface of the glass workpiece. When the walls contact the surface of the glass workpiece with the abrasive grains on them, the surface of the glass workpiece is polished so that asperities are leveled. Therefore, in each soft polisher that contacts the surface of the glass workpiece, a portion that affects the quality of the polished surface does not include pores themselves in the surface, but portions that contact the surface of the glass workpiece, that is, walls forming the pores.

For example, if the walls of the pores are thin or long so that the polisher is soft, the walls of the pores will yield to the surface of the glass workpiece and be likely to be deformed. In this case, defects such as micro-waviness on the surface and surface roughness are not sufficiently corrected. In contrast to this, if the walls are thick or short so that the polisher is hard, the walls of the pores are not likely to yield to the surface of the glass workpiece, and may damage the surface. Therefore, when examined under microscopic analysis where walls forming the pores are considered, the soft polisher is required to be hard to sufficiently correct defects such as surface roughness, and to be soft not to damage the surface of the glass workpiece at the same time. In other words, the soft polisher is required to have two conflicting properties.

Figure 1:
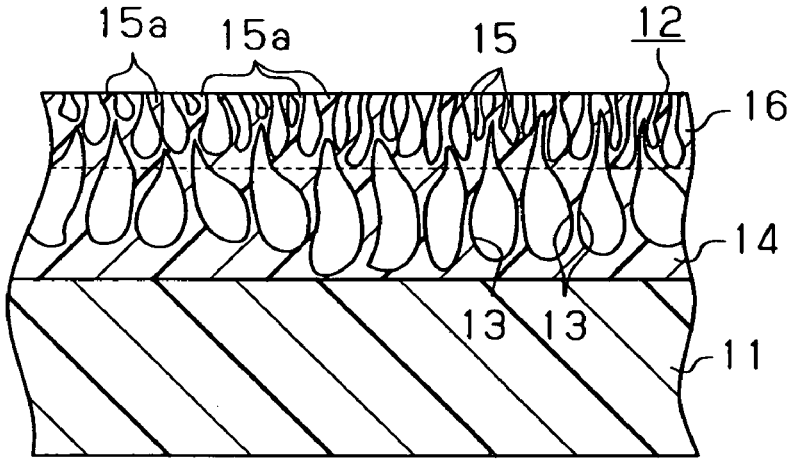
FIG. 1 is a cross-sectional view showing a soft polisher.

In view of the above requirement, the soft polisher used in the second polishing step has a structure schematically shown in FIG. 1. The soft polisher is formed of a base material 11 made of unwoven fabric, and a nap layer 12 laminated on the base material 11. The nap layer 12 has a two-layer structure, and includes an inner layer 14 in which closed cells 13 are formed, and an outer layer 16 in which pores 15 are formed. The pores 15 in the nap layer 12 open to the surface of the nap layer 12.

The closed cells 13 have droplet shape along the thickness of the nap layer 12. That is, each closed cell 13 expands toward the inner side and narrows toward the surface. The pores 15 are significantly smaller than-the closed cells 13. The pores 15 are independently formed and do not communicate with the closed cells 13. During polishing, walls 15*a* forming the pores 15 contact the surface of the glass workpiece with abrasive grains in between to polish the surface.

The soft polisher, which has the nap layer 12, is formed of a polishing pad that is not buffed in advance, or of a "non-buff pad". Buffing refers to polishing in which a grindstone is used to roughly grind the surface of the polishing pad made of foam. Immediately after being manufactured, a non-buff pad has no pores in the surface. The surface portion of the non-buff pad is then ground off through buffing, which opens inherent closed cells to form pores.

Figure 4A:
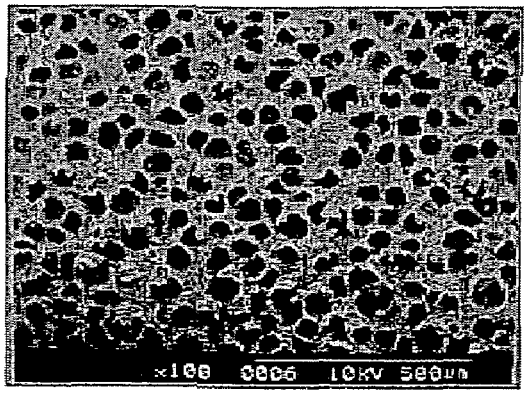
Fig.4(a) (Prior Art)
FIG. 4(*a*) is a view showing a surface of a prior art polishing pad taken with the SEM.
Figure 4B:
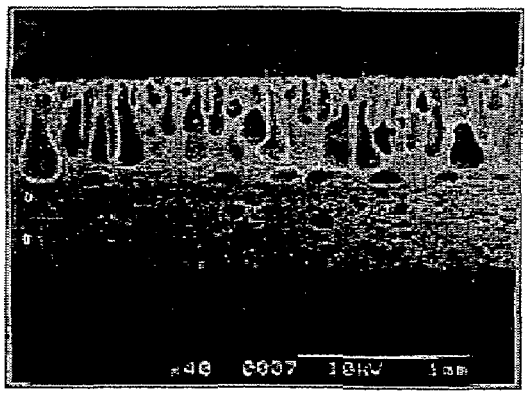
Fig.4(b) (Prior Art)

In a case of a prior art polishing pad, a portion above a broken line in FIG. 1, or the portion corresponding to the outer layer 16, is ground off. In this case, the closed cells 13 in the inner layer 14 are opened on the surface of the nap layer 12. As a result, the pores 15 are opened on the surface of the nap layer 12. The closed cells 13 have uneven sizes and shaped as droplets. Therefore, pores formed of the closed cells 13 are deep and have large opening. Also, depending on the position of the opening, the sizes of the openings vary. When such a prior art polishing pad is actually viewed with a scanning electron microscope (SEM), the nap layer appears different from the nap layer of this embodiment as shown in FIGS. 4(*a*) and 4(*b*). That is, the prior art polishing pad has a substantially one layer structure in which large closed cells are opened on the surface of the nap layer. The pores on the surface are scattered all over the polishing pad and have uneven diameters. The diameters and depths of the pores of the prior art polishing pad were measured. The diameters were 20 to 100 μm, and the depths were 400 to 700 μm.

Figure 3A:
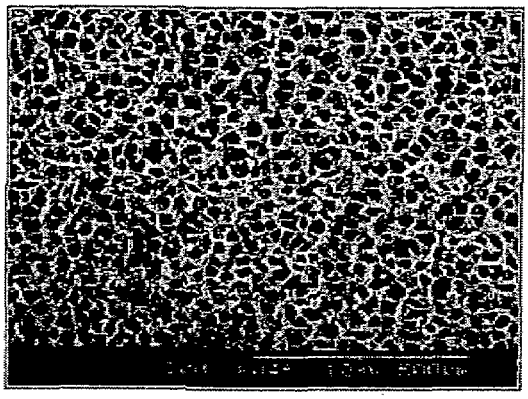
FIG. 3(*a*) is a view showing a surface of a soft polisher viewed with a scanning electron microscope (SEM)
Figure 3B:
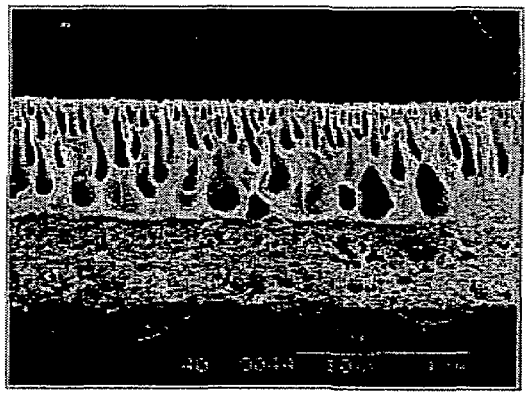

In this embodiment, attention is given to a surface portion that is ground off the prior art polishing pad by buffing, that is, to minute cells formed in the portion to be the outer layer 16. These minute cells are opened to form the pores 15. The pores 15, which are formed with the minute cells, are shallow and even and have small openings. When the surface and cross-section of the soft polisher of this embodiment are viewed with a scanning electron microscope (SEM), the nap layer has two-layer structure as shown in FIGS. 3(*a*) and 3(*b*). The pores are densely and substantially evenly scattered all over the surface of the soft polisher, and have substantially the same size. The reason why the cells on the surface of the non-buff pad are small is that, during manufacturing of the non-buff pad, the surface of the pad contacts a molding box, and therefore the cells are prevented from inflating.

To open the pores 15 without buffing, which would grind off the outer layer 16 of the soft polisher, a non-buff pad is subjected to pad dressing process, in which the amount of portion that is ground off the surface of the non-buff pad is adjusted, thereby forming the pores 15. The pad dress process refers to a process in which a non-buff pad is attached to the polishing apparatus, and the surface of the non-buff pad is polished with a dresser so that a small amount is ground off. Since the pad dressing process is performed with the non-buff pad being attached to the polishing apparatus, the surface of the soft polisher is flat without roughness in a state being attached to the polishing apparatus. The dresser is either a pad dresser, which is formed by electrodepositing diamond abrasive grains on the surface of a disk-shaped base material, or a pellet dresser, which is formed by embedding diamond pellets in the surface of the disk-shaped base material. In this embodiment, it is preferable to employ a pad dresser in the pad dressing process. This is because a pad dresser has finer grains compared to a pellet dresser, and this prevents the surface of the polishing pad from being excessively polished.

In the soft polisher, which is formed from a non-buff pad subjected to the pad dressing process, the nap layer 12 functions as a cushion because of the outer layer 16 having the closed cells 13. With the cushioning function, the soft polisher, when viewed macroscopically, has a softness to effectively polish the surface of the glass workpiece without greatly shaving off the surface. On the other hand, compared to the prior art polishing pads, the nap layer 12 has shallow pores 15 with a small opening. The walls 15*a* forming the pores 15 are thick and short, accordingly. Therefore, when viewed microscopically, the soft polisher has a hardness that sufficiently corrects defects such as the micro-waviness and the surface roughness. Particularly, since the surface of the soft polisher is hard when viewed microscopically, the surface of the soft polisher is prevented from being roughened. Thus, the flatness of the surface of the soft polisher does not deteriorate.

Specifically, the soft polisher has a hardness of 58 to 85 (Asker C) as classified in SRIS-0101 (SRIS: Society of Rubber Industry Japan Standards). The compression modulus of the soft polisher is preferably 58 to 90%. It is preferable to adhere the soft polishers to the lower surface plate 42*a* and the upper surface plate 42*b* such that the compressibility of the soft polishers is 1 to 5%.

If the soft polishers have an Askar C hardness less than 58, a compression modulus less than 58% or a compressibility more than 5%, the soft polishers are deformed during polishing, and have asperities and waviness on the surface. This will result in micro-waviness on the surfaces of the glass workpiece. If the Askar C hardness is greater than 85, the compression modulus is higher than 90% or the compressibility is less than 1%, the soft polishers scratch the surfaces of the glass workpiece. As a result, the surface of the manufactured glass substrate will be roughened. Since there are essential differences between the suede type soft polisher and the sponge type hard polishers, the polishers cannot be compared on the same criteria. Accordingly, the hardness of the hard polisher is expressed with JIS A hardness, while the hardness of the soft polisher is expressed with Asker C hardness.

The compression deformation amount, which represents the hardness of the soft polisher when viewed macroscopically, is preferably 40 to 60 μm. The compression deformation amount is computed by subtracting the thickness of the soft polisher when compressed to the limit along the thickness from the original thickness. If the compression deformation amount is less than 40 μm, the soft polisher will be excessively hard and likely to damage the surface of the glass workpiece. If the compression deformation amount exceeds 60 μm, the soft polisher will be excessively soft and not capable of sufficiently correct defects on the surface of the glass workpiece.

On the surface of the soft polisher, the number of the pores 15 is preferably 400 to 10,000 in 1 $mm^2$. The sizes of the pores 15 are preferably 10 to 60 μm. The depths of the pores 15 are preferably greater than 1 μm and less than 100 μm. If the number of the pores 15 is less than 400, the sizes are less than 10 μm, or the depths are less 1 μm, the walls 15*a* will be so thick or so long that, when viewed microscopically, the hardness of the soft polisher will be excessive and the soft polisher will likely to damage the surface of the glass workpiece during polishing. If the number is more than 10,000, the sizes are more than 60 μm, or the depths are more than 100 μm, the walls 15*a* are so thin or so long that, when viewed microscopically, the soft polisher will be excessively soft and the soft polisher will be incapable of sufficiently correcting defects from the surface of the glass workpiece.

Using the soft polisher in the second polishing step, the second polishing step is divided into a former polishing and a latter polishing. In the former and the latter polishing, different types of polishing agents are used in the same polishing apparatus so that precision polishing of the glass substrate will be performed. When different types of polishing agents are used in the same polishing apparatus, a rinse process with a cleaning liquid is performed between the former polishing and the latter polishing to remove the polishing agents from the surface of the glass workpiece.

In the former polishing, it is preferable to use a suspension, or slurry in which abrasive grains of cerium oxide are dispersed in water, as a polishing agent. The purpose of selecting cerium oxide as the abrasive grains for the former polishing is to roughly correct minute defects so that the polishing time in the second polishing is shortened. It is preferable to use abrasive grains of average size equal to or less than 1.5 μm. More preferably, the average size of the abrasive grains is 0.2 to 1.5 μm. If the average size of the abrasive grains is excessively large, the abrasive grains are likely to form scratches on the surface of the glass workpiece. If the average size of the abrasive grains is excessively small, the polishing amount in a unit of time is decreased, which results in an extended time for polishing.

In the rinse process, the polished surface of the glass workpiece is rinsed with cleaning liquid to remove deposits on the surface, such as abrasive grains or crushed pieces of the abrasive grains. As the cleaning liquid, water, pure water, alcohol such as isopropyl alcohol, electrolyzed water obtained by electrolyzing an aqueous solution of inorganic salt such as alkali metal salt such as sodium chloride, or a neutral aqueous solution such as functional water such as dissolved gas water in which gas is dissolved can be used.

If the rinse process is not performed and the latter polishing is performed with deposit on the surface, the deposit is likely to damage the surface of the glass workpiece. Particularly, the polishing agent of the former polishing is mixed with the polishing agent of the latter polishing. This degrades the polishing accuracy of the latter polishing. Therefore, the rinse process must be performed to rinse and wash the surface of the glass workpiece with cleaning liquid. In the prior art polishing pad, the polishing agent in the former polishing and the polishing agent in the latter polishing are highly likely to be mixed with each other even if the rinse process is performed. This is because, in the prior art polishing pad, the abrasive grains become embedded in the pores on the surface and cannot be washed away in the rinse process.

In contrast to this, since the pores 15 of the soft polisher of this embodiment have less depth and size, abrasive grains are prevented from being embedded in the pores 15. Further, since the pores 15 do not communicate with the closed cells 13, the abrasive grains caught in the pores 15 remain in the pores 15. The abrasive grains in the pores 15 are washed away from the pores 15 through rinse process and discharged to the outside.

In the latter polishing, it is preferable to use a suspension, or slurry in which abrasive grains of silicon oxide such as colloidal silica are dispersed in water, as a polishing agent. The reason why silicon oxide is used as abrasive grains is that the particles of silicon oxide are smaller in size than the particles of cerium oxide and thus effectively smooth the surface of the glass workpiece. That is, in the latter polishing, minute defects, which have been roughly corrected, are more finely and accurately corrected so that the smoothness of the surface of the glass workpiece is improved. The average size ($D_{50}$) of the abrasive grains is preferably equal to or less than 0.2 μm. If $D_{50}$ exceeds 0.2 μm, the glass workpiece will be damaged in the latter polishing, and a desirable smoothness cannot be achieved.

In the former polishing, the load applied to the soft polisher and the glass workpiece is preferably 50 to 120 g/cm$^2$. If the load is less than 50 g/cm$^2$, there is a possibility that the glass workpiece is not sufficiently precisely polished in the former polishing. In this case, the values of Ra and NRa of the manufactured glass substrate are increased. In other cases, the polishing time in the latter process needs to be extended so that Ra and NRa of the glass workpiece satisfy the desired values. If the load exceeds 120 g/cm$^2$, deformation of the surface of the soft polisher causes minute defects such as micro-waviness to be formed on the surface of the glass workpiece. Also, excessive load increases the values of Ra, NRa or cracks the disk plate in the former polishing.

In the latter polishing, load applied to the soft polisher and the glass workpiece is preferably 30 to 100 g/cm$^2$. If the load is less than 30 g/cm$^2$, the glass workpiece cannot be sufficiently polished in the latter polishing, and the values of the Ra and NRa of the manufactured glass substrate will be unsatisfactory. If the load exceeds 100 g/cm$^2$, deformation of the surface of the soft polisher causes minute defects such as micro-waviness to be formed on the surface of the glass workpiece. Also, excessive load increases the values of Ra, NRa or cracks the disk plate in the former polishing.

In the rinse process the load applied to the soft polisher and the glass workpiece is preferably less than the load in the former polishing. The load in the rinse process is preferably equal to or lower than the load in the latter polishing. Specifically, the load in the rinse process is preferably 25 to 70 g/cm$^2$. If the load is less than 25 g/cm$^2$, deposit cannot be sufficiently removed from the surface of the glass workpiece, or part of the abrasive grains can remain in the pores 15. If the load exceeds 70 g/cm$^2$, the load can crack the glass workpiece during the rinse process.

Among the former polishing, the rinse process, and the latter polishing, time spent for the latter polishing is preferably one to forty minutes. If the time spent of the latter polishing is less than one minute, it is possible that the surface of the glass workpiece is not sufficiently polished. If the time is longer than forty minutes, the smoothness of the glass workpiece cannot be further improved. The prolonged time for the latter polishing extends the total time of manufacture and lowers the productivity.

The time spent for the rinse process is preferably one to twenty minutes. If the time spent for the rinse process is less than one minute, the polishing agent used in the first polishing process cannot be sufficiently removed. This may form scratches on the surface of the glass workpiece in the second polishing process. If the time is longer than twenty minutes, the remaining polishing agent cannot be further removed. The prolonged time for the latter polishing extends the total time of manufacture and lowers the productivity.

The total time spent for the second polishing process is preferably seven to forty-five minutes. The total time is reduced to this level because the rinse process and the latter polishing are consecutively performed and do not require any process for changing the glass workpiece. If the total time is less than seven minutes, the time of at least one of the former polishing, the rinse process, and the latter polishing must be shortened or at least one of these must be omitted. In this case, the surface of the glass workpiece cannot be sufficiently polished or can be damaged. If the total time is longer than forty-five minutes, at least one of the former polishing, the rinse process, and the latter polishing will be excessive. If excessively extended, any of the former polishing, the rinse process, and the latter polishing cannot further improve the smoothness or the cleanness of the surface, but extends the manufacturing time. This will lower the productivity.

In a case where two or more polishing apparatuses are used and glass workpieces are moved among the apparatuses, and two or more glass workpieces are simultaneously polished in each apparatus, the thickness of the removal layer is highly likely to vary between one glass workpiece to another. If the thickness of the removal layer varies, a situation may occur in which one glass workpiece is sufficiently polished and has defects corrected, while another glass workpiece is not sufficiently polished and does not have defects corrected or has an increased number of defects due to excessive polishing. In this case, the polishing accuracy and the smoothness vary between one glass workpiece and another. Variation in the thickness of the removal layer is caused by variation in the thickness of the polished glass workpieces, changes in the surface condition of the polishing pads, and changes in the relative positions of the glass workpieces to the polishing pads.

Since the soft polisher used in the second polishing process has a surface that is hard if viewed microscopically, the surface maintains its flatness achieved by the pad dressing process. This prevents the surface from being roughened during each step in the second polishing process. In a single batch, the glass workpieces that are polished with the soft polisher having a flat surface polished by removing the substantially the same thickness of the removable layer. Therefore, there is little variation in the thickness. Particularly, in the second polishing process, the glass workpieces are polished to have substantially the same thickness in the former polishing. Through the former polishing, the rinse process, and the latter polishing, the surface is maintained flat, and the surface condition is prevented from being changed in the second polishing process. Further, in the former polishing, the rinse process, and the latter polishing, the glass workpiece is not moved between apparatus, but treated in the single polishing apparatus. Therefore, the position of the glass workpiece relative to the soft polisher is not changed.

Therefore, in the second polishing process, the thickness of the removal layer is prevented from being varied in the former polishing and the latter polishing. Therefore, in the batch type polishing apparatus, the polishing accuracy and the smoothness of the glass workpieces are substantially uniform. Specifically, the variation in the thickness of the removal layer in the glass workpieces manufactured by the batch type polishing apparatus is preferably equal to or less than 0.2 μm. If the variation of the thickness of the removal layer exceeds 0.2 μm, some of the glass workpieces in a single batch are excessively polished and some of the glass workpieces are not sufficiently polished. That is, the polishing accuracy and the smoothness are varied.

The above embodiment has the advantages described below.

The glass substrate in this embodiment is manufactured by roughly polishing a glass workpiece in the first polishing process, and subjecting the glass workpiece to the precision polishing in the second polishing process. In the second polishing process, the soft polisher is used as the polishing pad, which soft polisher has the nap layer 12. The nap layer 12 has a two-layer structure and has the inner layer 14 having the closed cells 13 and the outer layer 16 having the pores 15. The pores 15 in the nap layer 12 are shallower than surface pores in the prior art polishing pads, and the opening size of the pores 15 is smaller than that of the pores in the prior art polishing pads. Therefore, the walls 15*a* forming the pores 15 are harder than that of the prior art. Therefore, the soft polisher according to this embodiment is as a whole soft since it has the inner layer 14 in which the closed cells 13 are provided. At the same time, the soft polisher is hard at the surface, which contacts the surface of the glass workpiece, since it has the outer layer 16 in which the pores 15 are provided. The soft polisher, which is hard at the surface and soft as a whole, maintains the surface condition after being flattened by the pad dressing process and is capable of polishing the surface of the glass workpiece to smooth the surface. Therefore, among the soft polishers for polishing, one with a desirable surface condition is effectively selected, and the surface quality of the manufactured glass substrate is improved.

The number of the pores 15 on the surface of the soft polisher is 400 to 10,000 in 1 $mm^2$, and the size of the opening of the pores 15 is 10 to 60 μm. The compression deformation amount of the soft polisher is 40 to 60 μm. Therefore, the soft polisher has a sufficient hardness to correct the surface of the glass workpiece to be polished without damaging the surface of the glass workpiece.

EXAMPLES

Examples of the present embodiment will now be described.

Consideration Regarding Polishing Pad

In examples 1 and 2, and comparison examples 1 and 2, a glass workpiece was subjected to the first polishing. Then, the glass workpiece was subjected to the second polishing process using a soft polisher as a polishing pad, the soft polisher being made of polyurethane having properties shown in a table 1. The glass workpiece has an inner diameter of 20 mm, an outer diameter of 65 mm, and a thickness of 0.635 mm. In the first polishing process, the hard polisher of polyurethane was used as a polishing pad, and a polishing agent containing abrasive grains of cerium oxide having an average size of approximately 1.2 μm was used, and the polishing pressure was set to 100 g/$cm^2$. In the second polishing process, a polishing agent containing abrasive grains of cerium oxide having an average size of approximately 0.8 μm was used in the former polishing. In the latter polishing process, a polishing agent containing abrasive grains of colloidal silica having a $D_{50}$ of approximately 0.15 μm was used. Machining conditions of the second polishing process were that the former polishing was performed for five minutes with a load of 80 g/$cm^2$, the rinse process was preformed for five minutes with a load of 60 g/$cm^2$, and the latter polishing was performed for five minutes with a load of 60 g/cm. The soft polishers used in the examples 1 and 2 had been formed by subjecting non-buff pads to the pad dressing process. The soft polishers used in the comparison examples 1 and 2 had been polished with a buff. After polishing, the height NRa of microwaviness was measured for each glass workpiece. The results are shown in the following table 1.

TABLE 1

| | | Example 1 | Example 2 | Comparison Example 1 | Comparison Example 2 |
|---|---|---|---|---|---|
| Thickness | mm | 1.13 | 1.05 | 1.10 | 1.08 |
| Hardness | Asker-C | 74 | 74 | 71 | 78 |
| Compression Ratio | % | 2.1 | 2.2 | 2.5 | 1.5 |
| Compression Modulus | % | 71.9 | 73.3 | 75.2 | 86.7 |
| Size of Opening | μm | 10-40 | 30-60 | 40-80 | 30-80 |
| Number of Pores | number/1 $mm^2$ | 600-800 | 400-600 | 240-280 | 240-390 |
| Compression Deformation Amount | μm | 43 | 56 | 101 | 44 |
| NAP Surface Roughness Rmax | μm | 19 | 25 | 30 | 35 |
| NRa after polishing | nm | 0.13 | 0.14 | 0.18 | 0.16 |

As shown in the table 1, the height NRa of the micro-waviness of the glass workpieces obtained using the soft polishers of the examples 1 and 2 were equal to or less than 0.15 nm, and the surface conditions were favorable. In contrast to this, although the soft polisher of the comparison example 1 was softer than the ones of the examples 1 and 2 with respect to the Asker C hardness, the compression ratio, the compression modulus, and the compression deformation amount, the height NRa of the micro-waviness was 0.18 nm, which is more than 0.15 nm. The opening size of the pores of the soft polisher of the comparison example 1 was 40 to 80 μm. That is, the difference between a large pore and a small pore was 40 μm. The difference of the opening size of the comparison example 1 was therefore apparently greater than the variation of the examples 1 and 2. The number of the pores in the comparison example 1 was 240 to 280 in 1 $mm^2$, which is apparently less than that of the examples 1 and 2.

Although the soft polisher of the comparison example 2 was harder than the ones of the examples 1 and 2, and the surface roughness (Rmax) of the soft polisher of the comparison example 2 was higher than that of the comparison example 1, the height NRa of the micro-waviness was 0.15 nm. However, the soft polisher of the comparison example 2 was more desirable than that of the comparison example 1. The opening size was 30 to 80 μm, and the difference in the opening size was great. However, the number in 1 $mm^2$ was 240 to 390, which is close to those in the examples 1 and 2.

The above results show that using the soft polisher having a two-layer structure nap layer improves the height NRa of the micro-waviness. Also, the result reveals that the height NRa of the micro-waviness is not always lowered by lowering the surface roughness of a soft polisher, but the height NRa can be sufficiently corrected by optimizing the number and the size of the pores. The result also shows that the number of the pores is preferably 400 to 10,000 in 1 $mm^2$, more preferably 400 to 800, and most preferably 600 to 800. The opening size of the pores is preferably 10 to 60 μm, and more preferably 10 to 40 μm.

Consideration of Difference of Thickness of Removal Layer by Batch-type Polishing Apparatus Subsequently, using the soft polisher of the example 1 or the soft polisher of the comparison example 2, glass workpieces were polished by the polishing apparatus shown in FIG. 2. At this time, five carriers 47 were used in a single polishing, and each carrier 47 held five glass workpieces. The thickness of the removal layer of each glass workpiece was measured. The results are shown in tables 2 and 3. The table 2 shows the results of polishing by the soft polisher used in the example 1. The table 3 shows the results of polishing by the soft polisher used in the comparison example 1. In the tables, first to fifth carries each represent one of the five carriers 47. The first to fifth disks represent five glass workpieces held by each one of the carriers.

TABLE 2

Polishing Results of Soft Polisher of Example 1

| | Thickness of Removal Layer (μm) | | | | | Average Thickness | Maximum Difference of Thickness of | Difference of Average Thickness of Removal Layer |
|---|---|---|---|---|---|---|---|---|
| | First Disk | Second Disk | Third Disk | Fourth Disk | Fifth Disk | of the removal layer | Removal Layer in Each Carrier | relative to First Carrier |
| First Carrier | 1.0 | 1.1 | 1.0 | 0.9 | 0.9 | 1.0 | 0.2 | — |
| Second Carrier | 0.9 | 1.0 | 1.1 | 1.0 | 1.0 | 1.0 | 0.2 | 0.0 |
| Third Carrier | 1.0 | 1.1 | 1.2 | 1.0 | 1.0 | 1.1 | 0.2 | 0.1 |
| Fourth Carrier | 1.1 | 1.0 | 0.9 | 1.1 | 1.0 | 1.0 | 0.2 | 0.0 |
| Fifth Carrier | 1.0 | 1.1 | 1.1 | 1.1 | 1.0 | 1.1 | 0.1 | 0.1 |

TABLE 3

Polishing Results of Soft Polisher of Comparison Example 1

| | Thickness of Removal Layer (μm) | | | | | | Maximum Difference of Thickness of | Difference of Average Thickness of Removal Layer |
|---|---|---|---|---|---|---|---|---|
| | First Disk | Second Disk | Third Disk | Fourth Disk | Fifth Disk | Average Thickness of Removal layer | Removal Layer in Each Carrier | relative to First Carrier |
| First Carrier | 0.9 | 1.0 | 1.1 | 1.2 | 1.0 | 1.0 | 0.3 | — |
| Second Carrier | 0.2 | 0.5 | 1.5 | 0.9 | 0.9 | 1.2 | 1.5 | 0.2 |
| Third Carrier | 0.4 | 1.1 | 2.2 | 1.5 | 1.0 | 1.2 | 1.8 | 0.2 |
| Fourth Carrier | 1.2 | 1.0 | 0.9 | 1.2 | 1.2 | 1.1 | 0.3 | 0.1 |
| Fifth Carrier | 1.0 | 1.0 | 1.1 | 0.7 | 1.5 | 1.1 | 0.8 | 0.1 |

The variation of the thickness of removal layers was computed for each carrier. The results are shown in the table 2. When the soft polisher of the example 1 was used, the variation in the thickness of the removal layer was equal to or less than 0.2 μm. This means that there scarcely was variation in the thickness of the removal layers in each carrier. Also, the average of the thickness of the removal layers for each carrier was computed. Then, the variation between the averages between the carriers was computed. The variation of the averages was equal to or less than 0.1 μm. This means that there scarcely was variation in the thickness of the removal layers between the carriers.

In contrast to this, as shown in the table 3, when the soft polisher of the comparison example 1 was used, the maximum variation of the thickness of the removal layers between the carriers greatly varied and was in a range between 0.3 and 1.8 μm. This means that the thickness of the removal layer greatly varied in each carrier. Also, the difference of the average values was equal to or less than 0.2 μm. This means that there was variation of the thickness of the removal layers between the carriers. Accordingly, the results of the experiments show that, by using the soft polishers having a substantially two-layered nap layer, variation of the thickness of the removal layers can be reduced.

It should be apparent to those skilled in the art that the present invention may be embodied in many other specific forms without departing from the spirit or scope of the invention. Particularly, it should be understood that the invention may be embodied in the following forms.

To improve the impact resistance, the vibration resistance, and the heat resistance, which are required for a data recording medium, the glass workpiece may be subjected to the chemical strengthening process prior to the polishing process, after the polishing process, or between the polishing steps. The chemical strengthening process refers to a process in which monovalent metal ion, such as lithium ion and sodium ion, included in the composition of the glass substrate is replaced with monovalent metal ion having greater ion radius such as sodium ion and potassium ion. Thereafter, the surface of the glass substrate is chemically strengthened by applying compression stress to the surface. The chemical strengthening process is performed by immersing the glass substrate for a predetermined period in a chemical strengthening salt that is molten by heating. The chemical strengthening molten salt is, for example, one of or mixture of at least two of potassium nitrate, sodium nitrate and silver nitrate. The temperature of the chemical strengthening molten salt is lower than the strain point of the material used for the glass substrate preferably by 50 to 150° C. More preferably, the temperature of the chemical strengthening molten salt is 300 to 450° C. If the temperature of the molten salt is less than a temperature that is lower than the strain point of the material of the glass substrate by approximately 150° C., the glass substrate is not sufficiently chemically strengthened. If the temperature of the molten salt surpasses a temperature that is lower than the strain point of the material of the glass substrate by 50° C., the chemical strengthening process can create distortion in the glass substrate.

In the illustrated embodiment, the polishing process is performed using the batch type polishing apparatus. However, the polishing may be carried out in a sheet mode, in which glass substrates are polished one by one.

If the surface conditions of the glass workpiece, such as the roughness, the curling, and the waviness satisfy desired values after the chamfering process, the lapping process may be omitted. In this case, the manufacturing time will be reduced.

In the illustrated embodiment, the precision polishing of the second polishing process is performed in two steps, namely the former polishing and the latter polishing. However, the precision polishing may be performed in a single step. If the precision polishing is performed in a single step, the polishing agent that is used in the latter polishing of the illustrated embodiment is preferably used for the single polishing step since the glass workpiece must be smoothed at a high precision.

In the illustrated embodiment, the soft polisher used in the second polishing process is a polishing pad having a two-layer structure nap layer. However, a polishing pad having a two-layer structure nap layer may be used as the hard polisher used in the first polishing process. If a polishing pad having two-layer structure nap layer is used as the hard polisher, variation in the thickness of the removal layer is suppressed in the rough polishing. Further, the polishing accuracy and the smoothness of the glass workpiece in the rough polishing will be uniform.

Therefore, the present examples and embodiments are to be considered as illustrative and not restrictive and the invention is not to be limited to the details given herein, but may be modified within the scope and equivalence of the appended claims.

The invention claimed is:

1. A method for manufacturing a glass substrate of an information recording medium by polishing a surface of a glass workpiece with a polishing pad, wherein the polishing pad comprises a nap layer having an inner layer and an outer layer, wherein the inner layer comprises a plurality of closed cells, and a plurality of pores are formed on the surface of the outer layer, and wherein the sizes of said pores are minute compared to those of said closed cells, wherein polishing includes a first polishing step for subjecting a surface of the glass workpiece to rough polishing, and a second polishing step for subjecting the surface of the glass workpiece to precision polishing so that the surface is further smoothed, wherein the polishing pad is used in a second polishing step, wherein said polishing pad comprises from 400 to 10,000 of said pores in 1 $mm^2$, wherein a compression deformation amount of the polishing pad is 40 to 60 μm, wherein the compression deformation amount is computed by subtracting the thickness of the polishing pad when compressed to the limit along the thickness from the original thickness, and, wherein said pores have an opening size of from 10 to 60 μm.

2. The method according to claim 1, wherein the glass workpiece is one of a plurality of glass workpieces that are simultaneously polished on the same apparatus, wherein the variation of the thickness of removal layers among the glass workpieces is equal to or less than 0.2 μm.

3. The method according to claim 1 wherein the second polishing step includes a former polishing and a latter polishing, in the former and the latter polishing, different sizes of polishing agents are used.

4. The method according to claim 3, further comprising a rinse process with a cleaning liquid performed between the former polishing and the latter polishing.

5. The method according to claim 3, wherein the polishing agent used in the latter polishing is smaller in size than the polishing agent used in the former polishing.

* * * * *